US011485001B2

(12) United States Patent
Mustoe

(10) Patent No.: US 11,485,001 B2
(45) Date of Patent: Nov. 1, 2022

(54) HINGE PIN REMOVER TOOL

(71) Applicant: Tracy Mustoe, Fallbrook, CA (US)

(72) Inventor: Tracy Mustoe, Fallbrook, CA (US)

( * ) Notice: Subject to any disclaimer, the term of this patent is extended or adjusted under 35 U.S.C. 154(b) by 0 days.

(21) Appl. No.: 15/445,204

(22) Filed: Feb. 28, 2017

(65) Prior Publication Data

US 2017/0252909 A1 Sep. 7, 2017

Related U.S. Application Data

(60) Provisional application No. 62/389,481, filed on Mar. 1, 2016.

(51) Int. Cl.
*B25B 27/04* (2006.01)
*E05D 7/10* (2006.01)

(52) U.S. Cl.
CPC ..... *B25B 27/04* (2013.01); *E05D 7/1005* (2013.01); *Y10T 29/53943* (2015.01)

(58) Field of Classification Search
CPC ..... B23P 19/04; B25B 27/14; B25B 27/04; B25B 27/0007; E05D 11/06
USPC .... 29/244, 275, 278, 267, 255; 254/97, 275, 254/95
See application file for complete search history.

(56) References Cited

U.S. PATENT DOCUMENTS 4,354,375 A * 10/1982 Lesowsky ..... B25B 27/0007 254/95
7,152,293 B2 * 12/2006 Abrahamson ..... B25B 27/04 29/244
7,971,329 B1 * 7/2011 Brohard ..... B25B 27/04 29/275
2005/0268448 A1 * 12/2005 Jones ..... E05D 11/00 29/270

* cited by examiner

*Primary Examiner* — Katina N. Henson
(74) *Attorney, Agent, or Firm* — John R. Ross; John R. Ross, III

(57) ABSTRACT

A hinge pin remover for removing a hinge pin from a door hinge assembly. A geared wheel is rotatably connected to a hinge pin remover body. The geared wheel includes a plurality of geared wheel teeth. A handle is rigidly connected to the geared wheel. A geared shaft extends through the remover body. The geared shaft includes a plurality of geared shaft teeth. The geared shaft teeth are engaged with the geared wheel teeth. A lower push rod is connected to the geared shaft and is for pushing the hinge pin as the geared wheel is rotated. A forked clip is slidingly connected to the geared shaft and is for pulling the hinge pin as the geared wheel is rotated.

9 Claims, 3 Drawing Sheets

HINGE PIN REMOVER TOOL

The present invention relates to hand tools, and in particular to hand tools for removing door hinge pins. This application claims the benefit of U.S. Provisional Application No. 62/389,481, filed on Mar. 1, 2016, all of which is incorporated by reference herein.

BACKGROUND OF THE INVENTION

A door hinge (also known as a door hinge assembly) is very common in society. A typical door hinge assembly includes a door hinge pin that extends through the door hinge assembly. The hinge assembly is connected between the door and the door frame and allows for the opening and closing of the door.

Often it is necessary to remove the door for maintenance, repairs, or other reasons. To remove the door from the door frame, the user must first remove the hinge pin. The most common way to do this is to use a hammer and a screwdriver. The user typically places the screwdriver against the bottom of the hinge pin with and then taps the screwdriver with the hammer to push the pin out. This method can unfortunately cause damage to the hinge pin, the hinge assembly, the door, the door frame, and the surrounding walls.

There are prior art hinge pin removers, but they tend to be cumbersome, expensive, impractical and ineffective.

What is needed is a better hinge pin remover.

SUMMARY OF THE INVENTION

The present invention provides a hinge pin remover for removing a hinge pin from a door hinge assembly. A geared wheel is rotatably connected to a hinge pin remover body. The geared wheel includes a plurality of geared wheel teeth. A handle is rigidly connected to the geared wheel. A geared shaft extends through the remover body. The geared shaft includes a plurality of geared shaft teeth. The geared shaft teeth are engaged with the geared wheel teeth. A lower push rod is connected to the geared shaft and is for pushing the hinge pin as the geared wheel is rotated. A forked clip is slidingly connected to the geared shaft and is for pulling the hinge pin as the geared wheel is rotated.

BRIEF DESCRIPTION OF THE DRAWINGS

FIGS. 3A-3F show components of a preferred embodiment of the present invention.

FIGS. 4-7 show a sequence explaining the usage of a preferred embodiment of the present invention.

DETAILED DESCRIPTION OF THE PREFERRED EMBODIMENTS

Figure 4:
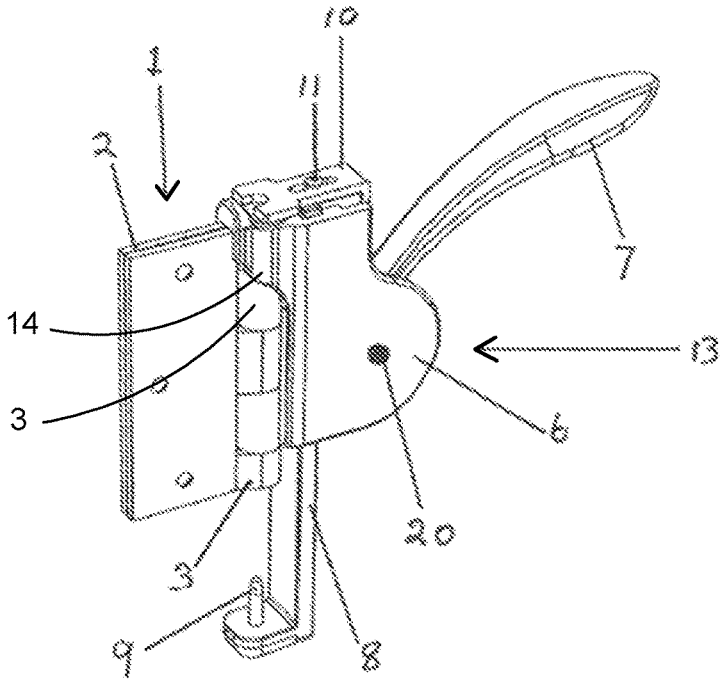
Figure 5:
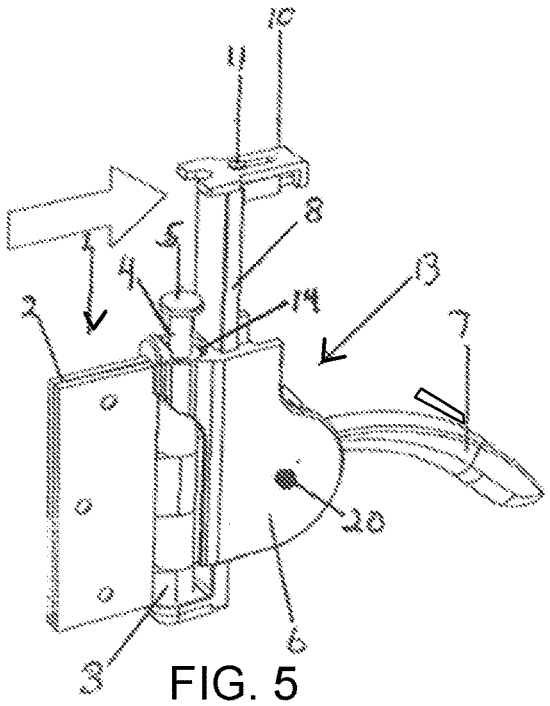
Figure 8:
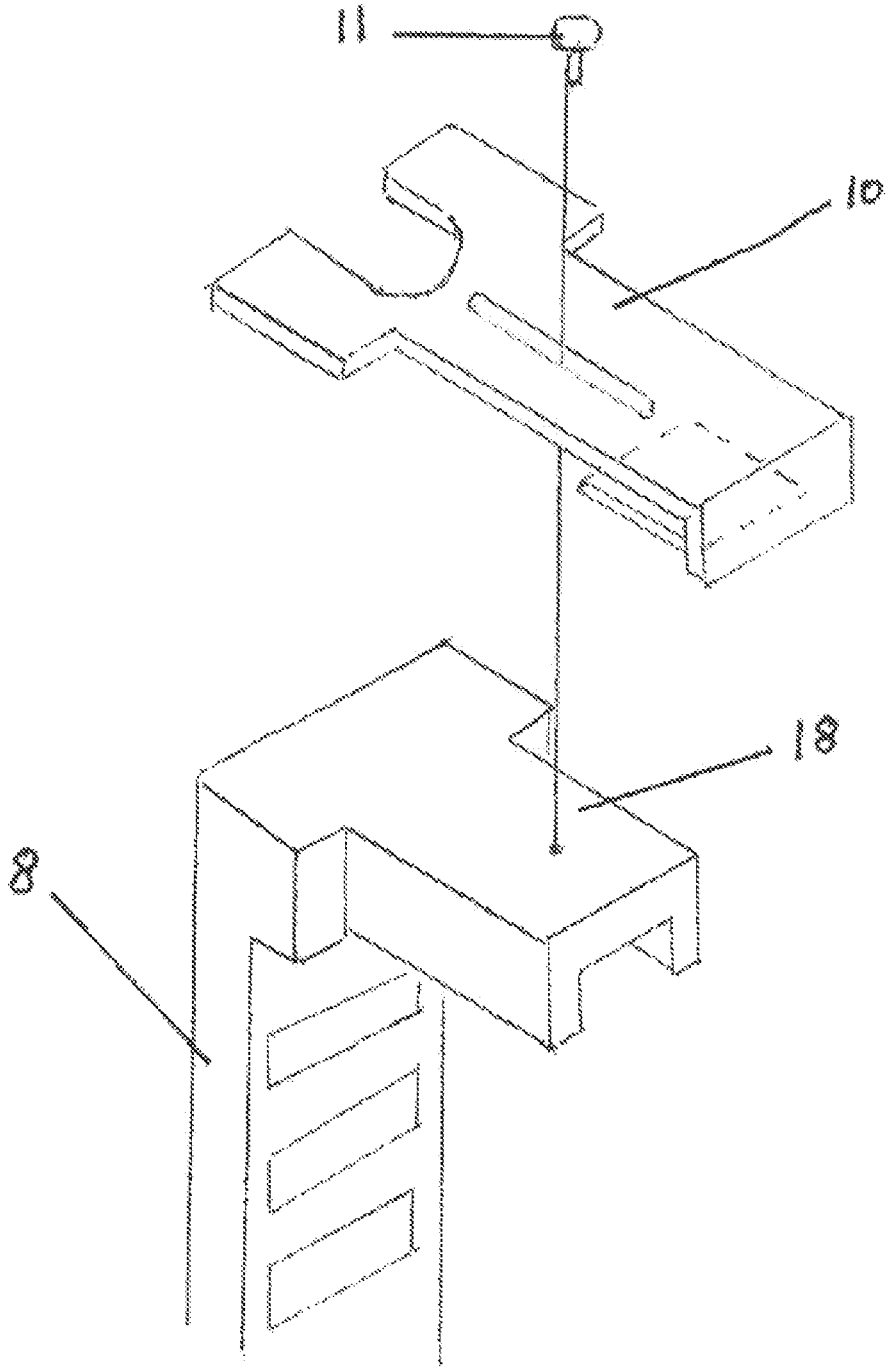
FIG. 8 shows details of a preferred forked clip.

FIGS. 4-5 show the utilization of hinge pin remover 13. Hinge pin remover 13 is utilized to remove hinge pin 5 from hinge assembly 1. Initial downward motion on lever 7 causes lower push rod 9 (FIG. 4) to push hinge pin 5 upward. Later downward motion on lever 7 then causes forked clip 10 to pull hinge pin 5 upward to fully remove it from hinge assembly 1 (FIGS. 4-7).

Components of Hinge Remover

Figure 1:
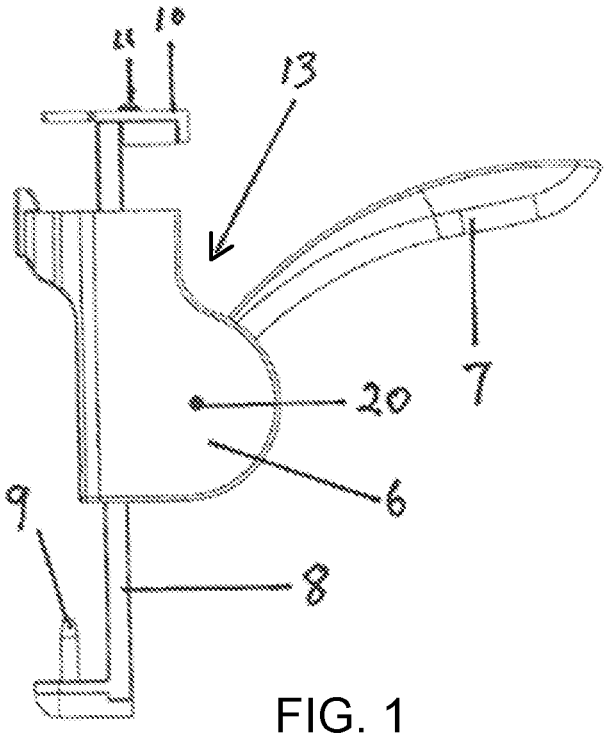
FIGS. 1 and 2 show side views of a preferred embodiment of the present invention.
Figure 2:
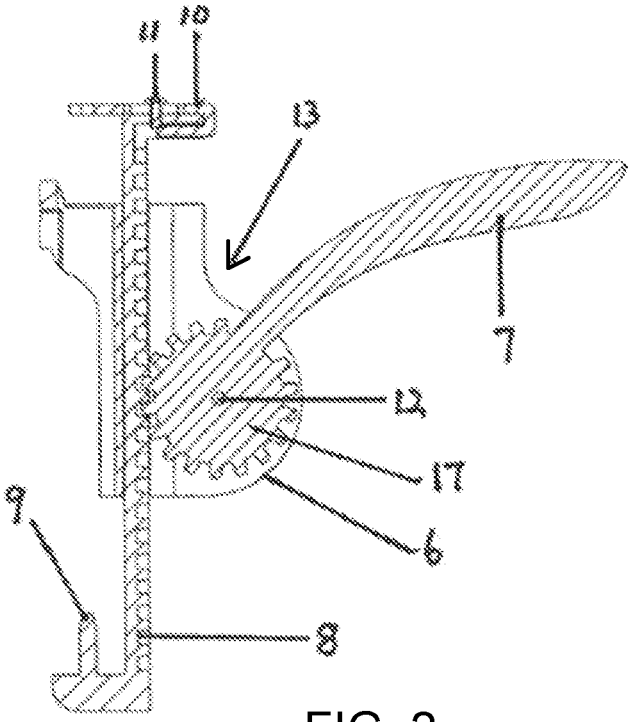

FIGS. 1 and 2 show a side view of hinge remover 13. FIGS. 3A-3F show front and side views of individual components of hinge remover 13.

Forked Clip

Forked clip 10 is sliding connected to upper arm 18 of geared shaft 8 (FIGS. 1, 2, 3D, and 8). Forked clip 10 preferably includes retainer pin 11 (FIGS. 1, 2, and 3F) that is utilized to prevent forked clip 10 from sliding off upper arm 18.

Geared Shaft

Geared shaft 8 extends downward through body 6 (FIGS. 1 and 2). Geared shaft 8 includes rigidly attached upper arm 18 at its upper end and rigidly attached lower arm 19 at its lower end (FIG. 3A). Tapered push rod 9 is rigidly connected to lower arm 19 and extends upward from lower arm 19 as shown.

Geared Wheel

Geared wheel 17 includes hole 12 and is rotatably connected to body 6 via axle rod 20 (FIG. 3E). Axle rod 20 is rigidly connected to body 6 and extends through hole 12 of geared wheel 17. Teeth 17*b* of geared wheel 17 engage teeth 8*b* of geared shaft 8. Handle 7 is rigidly connected to geared wheel 17. As handle 7 is rotated downward, geared shaft 8 is moved upward (FIGS. 4-7).

Body

Body 6 includes circular collar 14 which surrounds hinge assembly 1 and is supported by hinge assembly 1 (FIG. 4). Body 6 also includes shaft channel 15 that holds and guides the vertical movement of geared shaft 8. Body 6 includes parallel body walls 16*b* that forms slot 16. Axle rod 20 (FIG. 3E) extends through hole 21 of body 6 and hole 12 of geared wheel 7 to provide for rotatable connection of geared wheel 7.

Utilization of Hinge Remover

Hinge pin 5 is preferably removed when the door is closed. Hinge assembly 1 includes hinge wings 2. One of hinge wings 2 is rigidly connected to the door (not shown) and the other hinge wing is connected to the door frame (not shown).

In FIG. 4 the user has mounted hinge remover 13 onto hinge assembly 1. Circular collar 14 surrounds upper hinge knuckle 3 and is resting on hinge assembly 1 as shown. Rod 9 is positioned below hinge pin 5, which is inserted through hinge knuckles 3. Handle 7 is up.

In FIG. 5 the user has pushed handle 7 downward. This has caused geared shaft 8 to move upward. Consequently, rod 9 has moved upward and has pressed against hinge pin 5 causing it to be pushed upward a short distance equal to the length of rod 9, as shown. Also, the user has slid forked clip 10 to the right.

In FIG. 6, the user has raised handle 7 as shown, causing forked clip 10 to move to a vertical height that is lower than hinge pin head 5*b*. The user has then slid forked clip 10 to the left so that forked clip 10 is in contact with hinge pin 5 and is also vertically under head 5*b*, as shown.

In FIG. 7, the user has pushed handle 7 downward causing geared shaft 8 to move upward. Forked clip 10 consequently has pressed upward on hinge pin head 5*b* causing hinge pin 5 to be pulled upward from the top of the hinge pin so that the user can easily grasp it with his fingers and remove hinge pin 5 from hinge assembly 1.

While the present invention has been described in terms of preferred embodiments, the reader should consider these described embodiments only as particular embodiments. Many other embodiments are possible. Therefore, the reader should determine the scope of the present invention by the claims and their legal equivalents.

What is claimed is:

1. A method for using a hinge pin remover, said method comprising the steps of:

A. mounting said hinge pin remover onto a hinge assembly, said hinge pin remover comprising:

i. a remover body, ii. a geared wheel rotatably connected to said remover body, said geared wheel comprising a plurality of geared wheel teeth, iii. a handle rigidly connected to said geared wheel, iv. a geared shaft extending through said remover body, said geared shaft comprising a plurality of geared shaft teeth, wherein said plurality of geared shaft teeth are engaged with said plurality of geared wheel teeth, v. a lower push rod for pushing said hinge pin as said geared wheel is rotated, wherein a forked clip access space underneath said hinge pin head is created when said lower push rod pushes said hinge pin, said lower push rod connected to said geared shaft, and vi. a forked clip slidingly connected to said geared shaft, wherein said forked clip slides horizontally relative to said geared shaft and into said forked clip access space under said hinge pin head, said forked clip is for pulling said hinge pin as said geared wheel is rotated, B. pushing said handle downward causing said geared shaft to move upward and causing said lower push rod to move upward and press against said hinge pin causing it to be pushed upward, C. sliding said forked clip horizontally away from said hinge pin, D. raising said handle causing said forked clip to be moved to a vertical height lower than hinge pin head, E. sliding said forked clip horizontally towards said hinge pin so that said forked clip is under said forked clip head, and F. pushing said handle downward causing said geared shaft to move upward causing said forked clip to press upward on said hinge pin head causing said hinge pin to be pulled upward from the top of said hinge pin wherein said hinge pin may be removed from said hinge pin assembly by grasping said hinge pin with fingers and pulling.

2. The method as in claim 1, wherein said remover body comprises an:

a. axle rod connected to said remover body, wherein said geared wheel rotates around said axle rod, and b. a circular collar for surrounding at least one knuckle of said door hinge assembly and for resting on said hinge assembly for support, and c. a shaft channel extending through said remover body and for guiding vertical motion of said geared shaft.

3. The method as in claim 1, wherein said geared shaft comprises:

a. a rigidly attached upper arm, wherein said forked clip is slidingly connected to said rigidly attached upper arm, wherein said forked clip slides horizontally relative to said rigidly attached upper arm, and b. a rigidly attached lower arm, wherein said lower push rod is rigidly connected to said rigidly attached lower arm.

4. The method as in claim 1, further comprising a retaining pin connected to said geared shaft for retaining said forked clip onto said geared shaft as said forked clip is slid.

5. The method as in claim 1, wherein said remover body comprises an axle rod connected to said remover body, wherein said geared wheel rotates around said axle rod.

6. The method as in claim 1, wherein said remover body comprises a circular collar for surrounding at least one knuckle of said door hinge assembly and for resting on said hinge assembly for support.

7. The method as in claim 1, wherein said remover body comprises a shaft channel extending through said remover body and for guiding vertical motion of said geared shaft.

8. The method as in claim 1, wherein said geared shaft comprises a rigidly attached upper arm, wherein said forked clip is slidingly connected to said rigidly attached upper arm, wherein said forked clip slides horizontally relative to said rigidly attached upper arm.

9. The method as in claim 1, wherein said geared shaft comprises a rigidly attached lower arm, wherein said lower push rod is rigidly connected to said rigidly attached lower arm.

* * * * *